US007029232B2

(12) United States Patent
Tuffs et al.

(10) Patent No.: US 7,029,232 B2
(45) Date of Patent: Apr. 18, 2006

(54) ABRADABLE SEALS

(75) Inventors: Martin Tuffs, Nottingham (GB); Mark Henry Shipton, deceased, late of Bristol (GB); by Joanne M Shipton, legal representative, Bristol (GB); Junfa Mei, Birmingham (GB); Xinhua Wu, Birmingham (GB)

(73) Assignee: Rolls-Royce PLC, London (GB)

( * ) Notice: Subject to any disclaimer, the term of this patent is extended or adjusted under 35 U.S.C. 154(b) by 58 days.

(21) Appl. No.: 10/751,895

(22) Filed: Jan. 7, 2004

(65) Prior Publication Data

US 2004/0265120 A1 Dec. 30, 2004

(30) Foreign Application Priority Data

Feb. 27, 2003 (GB) ..... 0304546
Dec. 16, 2003 (GB) ..... 0329085

(51) Int. Cl.
*F01D 11/08* (2006.01)

(52) U.S. Cl. ..... 415/173.1

(58) Field of Classification Search ..... 415/173.4, 415/173.1, 173.5, 174.4, 174.5
See application file for complete search history.

(56) References Cited

U.S. PATENT DOCUMENTS

| | | | | |
|---|---|---|---|---|
| 3,547,455 | A * | 12/1970 | John | 277/415 |
| 3,583,824 | A * | 6/1971 | Smuland et al. | 415/117 |
| 4,198,839 | A * | 4/1980 | Linko et al. | 72/199 |
| 4,323,756 | A | 4/1982 | Brown et al. | |
| 4,395,196 | A * | 7/1983 | Plautz | 415/174.4 |
| 5,160,822 | A | 11/1992 | Aleshin | |
| 5,622,638 | A | 4/1997 | Schell et al. | |
| 5,704,759 | A | 1/1998 | Draskovich et al. | |
| 6,485,025 | B1 * | 11/2002 | Hammersley et al. | 277/414 |
| 6,499,940 | B1 * | 12/2002 | Adams | 415/9 |
| 6,644,914 | B1 * | 11/2003 | Lawer et al. | 415/173.4 |
| 6,689,487 | B1 * | 2/2004 | Murphy | 428/632 |

FOREIGN PATENT DOCUMENTS

| | | |
|---|---|---|
| EP | 0 837 222 A1 | 4/1998 |
| EP | 1 146 204 A2 | 10/2001 |

* cited by examiner

*Primary Examiner*—Edward K. Look
*Assistant Examiner*—Devin Hanan
(74) *Attorney, Agent, or Firm*—Oliff & Berridge, PLC

(57) ABSTRACT

A sealing element for a turbine of a gas turbine engine includes a radially inner surface region provided with an integrally formed seal structure comprising a plurality of radially inwardly projecting walls. The walls may be abradable and may define cells for receiving an abradable sealing material.

27 Claims, 8 Drawing Sheets

ABRADABLE SEALS

BACKGROUND

The invention relates to an abradable seal for a gas turbine engine.

In gas turbine engines, some of the aerofoil blades and in particular the turbine blades are conventionally surrounded by a sealing structure, which may comprise an annular seal or a seal segment ring made up of a plurality of arc shaped seal segments. Because the turbine blades expand and contract as their temperatures vary in use and centrifugal loads are imposed upon them, it is normal to provide a small gap between the turbine blade tips and the seal, to allow for this fluctuation.

It is known to provide an abradable seal for sealing between the turbine blade tips and the sealing structure. This enables the tips of the turbine blades to wear away the seal to an optimum size and shape without causing damage to the turbine blade tips. Such abradable seals may consist of an open cell foil honeycomb which is brazed in place and subsequently filled with a suitable abradable material, such as a metallic powder. As stated in the European Patent Application EP1146204 it is also known to directly machine, perhaps by electro discharge machining (EDM), a sealing segment made from an oxidation resistant alloy to form a honeycomb structure that is also filled with a suitable abradable material, such as a metallic powder. In both cases the honeycomb acts as a support for the abradable material. The supporting honeycomb is subsequently partially worn away by the rotating turbine blades, thus forming a seal.

SUMMARY

Certain problems are associated with the above seals. The seals may suffer from progressive oxidation attack if the foil material has inadequate oxidation resistance. In addition, problems may be experienced with the brazed joints, and the seals may be difficult to cool.

Additional problems arise when the honeycomb structure has worn and needs to be refurbished. Sealing components produced by vacuum brazing thin foil honeycomb structures to a sealing segment are refurbished by machining away remnants of the worn honeycomb and re attaching a new honeycomb via vacuum brazing. While the brazing quality may be adequate for low temperature applications, at elevated temperatures the brazing will lose its integrity and fail, thereby limiting this technique to low temperature applications.

Where abradable portions have been machined from a solid sealing segment it is required to replace the seal segment in its entirety, thereby adding to the overall cost of the refurbishment process.

According to the invention, there is provided a sealing element for positioning radially outwardly of at least some of the aerofoil blades of a gas turbine engine, a radially inner surface region of the sealing element including a seal structure formed as a plurality of inwardly projecting walls characterised in that said projecting walls are formed by powder fed laser weld deposition.

Powder fed laser welding has previously been employed in the refurbishment of gas turbine engine components, but only for the refurbishment of turbine blades. Specifically the technique has been used to build up blade tips that have been worn away during engine running with the capability to provide a wall thickness up to approximately 1.0 mm. Laser welding can create a cell structures not achievable by other machining methods such as EDM. Structures for EDM have to account for EDM tool withdrawal after machining is complete and are therefore limited to producing tapered structures with no overhangs. Additionally laser welding obviates the need for expensive tooling and permits a larger range of materials to be used for forming the cell structure.

The sealing element may comprise or form part of a generally annular housing for surrounding the tips of the blades of the turbine of said engine. The sealing element may comprise a seal segment.

Preferably the walls project substantially radially inwardly. The walls may also be configured to project inwardly at an angle of up to about 30 degrees from the radial direction.

Preferably radially inner edges of the walls define a substantially arc shaped inner face of the sealing element.

Preferably the seal structure is provided over substantially the whole of a radially inner surface region of the sealing element.

The thickness of the walls may reduce generally towards their radially inner edges. The walls may be shaped to form a plurality of radially open cells and each cell may be open only at a radially inner side. One or more of the cells may be substantially diamond shaped when viewed in the radial direction. The cells may be all substantially the same size or may be different sizes. The thickness of the walls may increase at their radially inner edges, such that the size of the cells reduces at their open radially inner sides.

According to the invention there is further provided a sealing element, wherein openings between the walls are at least partially filled with an abradable sealing material. The abradable sealing material may protrude radially inwardly beyond radially inner edges of the walls.

The walls may be abradable. By "abradable" it is meant that the material may be worn away by contact with the tips of rotating aerofoil blades, without causing significant damage to the blade tips.

According to the invention there is further provided a seal segment ring for a turbine of a gas turbine engine, the seal segment ring including a plurality of sealing elements as defined in any of the preceding nine paragraphs.

According to the invention there is further provided a gas turbine engine including a turbine comprising a seal segment ring as defined in the preceding paragraph. The turbine may be the high pressure turbine of the gas turbine engine.

According to the invention there is further provided a method of manufacturing a sealing element for positioning radially outwardly of at least some of the aerofoil blades of a gas turbine engine, the method including the step of integrally forming in a radially inner surface region of the seal segment a seal structure comprising a plurality of radially inwardly projecting walls.

The projecting walls may be deposited onto a structure onto a substrate using powder fed laser welding. The weld deposited structure is machined using conventional techniques to achieve the close tolerances necessary.

According to the invention there is further provided a sealing element wherein one or more of the cells is substantially diamond shaped when viewed in the radial direction.

According to the invention there is further provided a sealing element wherein the inwardly projecting walls are provided in a chevron pattern.

According to the invention there is further provided a sealing element according to wherein the inwardly projecting walls are provided in an arcuate pattern.

According to the invention there is further provided a sealing element wherein the inwardly projecting walls are provided at an angle to the longitudinal axis of the engine that the seal is built into.

According to the invention there is further provided a sealing element wherein the inwardly projecting walls are provided substantially circumferentially around the radially inner surface of the sealing element.

Powder fed laser welding makes it possible to build up the projecting walls directly, with or without a subsequent machining operation. The projecting walls are formed from an alloy with temperature capability similar to or better than the substrate.

The substrate may be made from any oxidation resistant material and need not be a costly highly oxidation resistant material. Utilising this technique to deposit high oxidation resistant material only where it is required allows a cheaper material to be selected for the substrate, thereby reducing the overall cost of the finished component.

An abradable is laid in the cells to help further reduce over tip leakage. If the walls are worn away or oxidised then this method provides a method of refurbishing the component to its original dimensions by depositing a network of inwardly projecting walls, or grid, onto the substrate surface. Some finish machining may be required.

Powder fed laser welding also has the advantage that it allows abradable patterns that have more complex geometries and which retain the abradable filler more effectively.

BRIEF DESCRIPTION OF THE DRAWINGS

Embodiments of the invention will be described for the purpose of illustration only, with reference to the accompanying drawings in which.

DETAILED DESCRIPTION OF EMBODIMENTS

Figure 1:
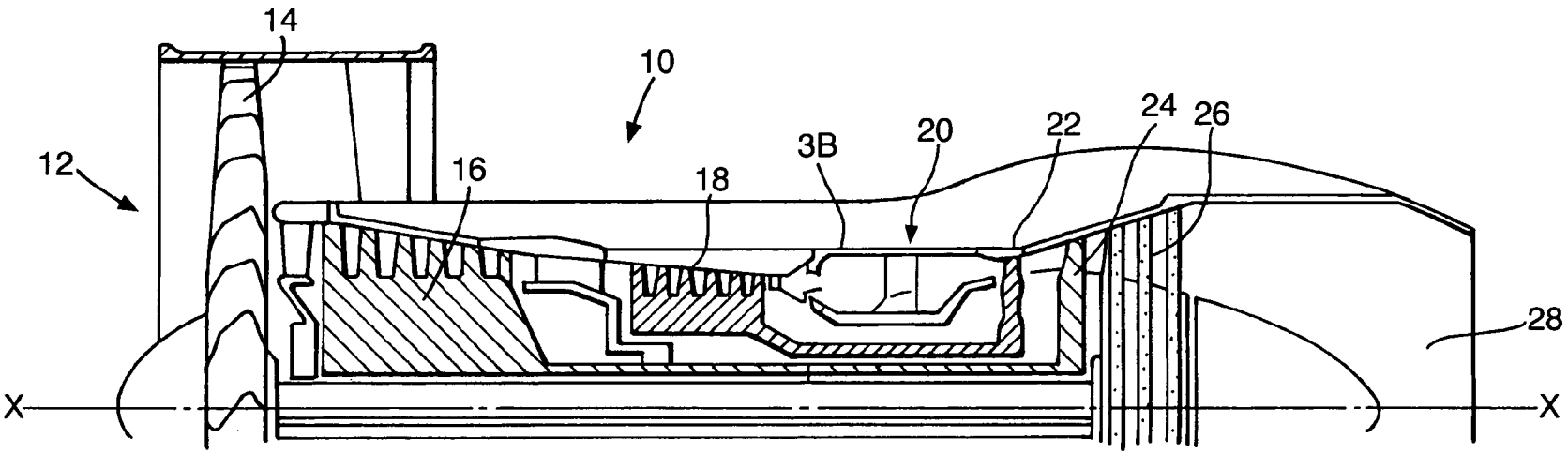
FIG. 1 is a schematic diagram of a ducted fan gas turbine engine.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Figure 2:
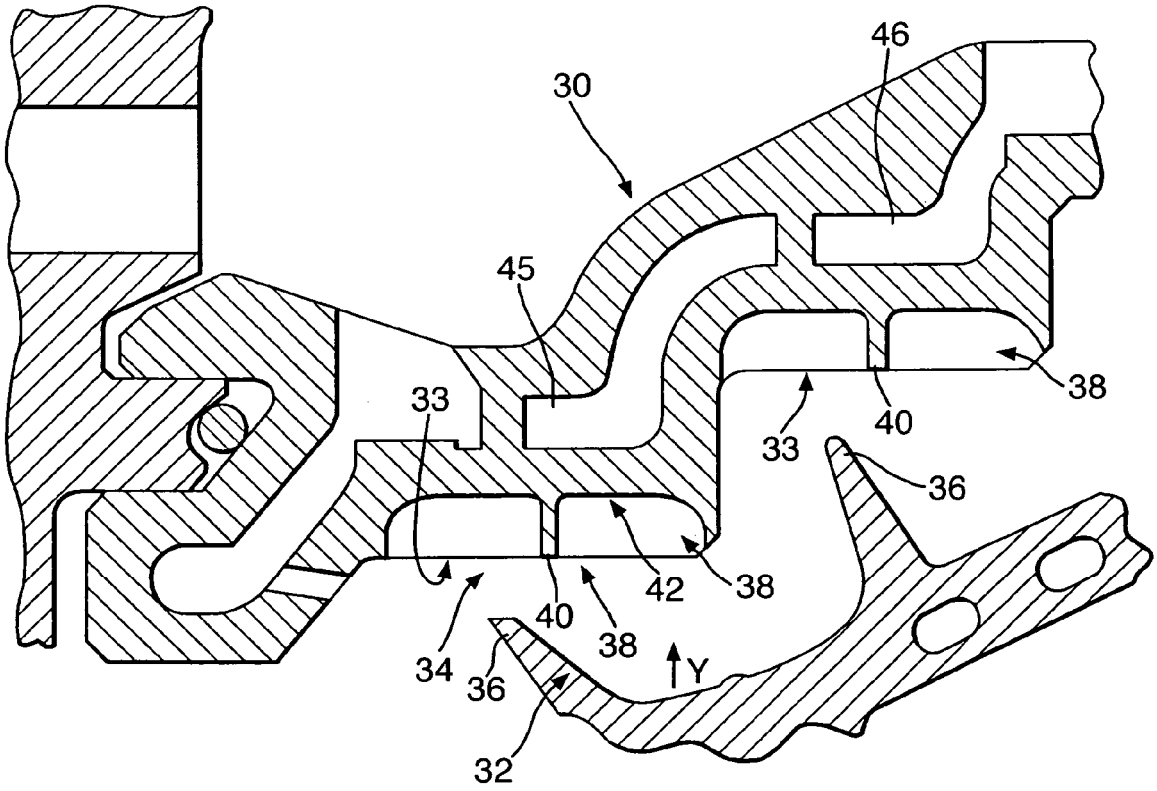
FIG. 2 is a diagrammatic section through a turbine seal segment according to the invention.
Figure 3:
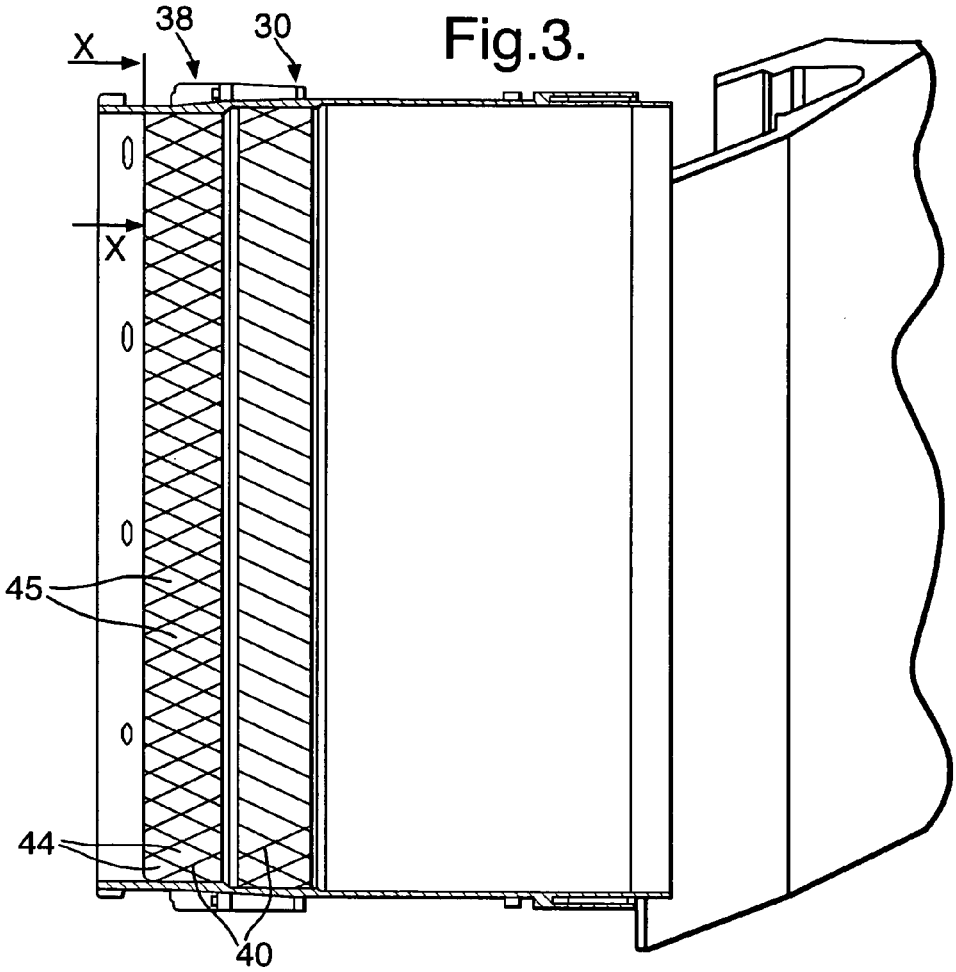
FIG. 3 is a diagrammatic view in the direction of the arrow Y in FIG. 2.
Figure 4:
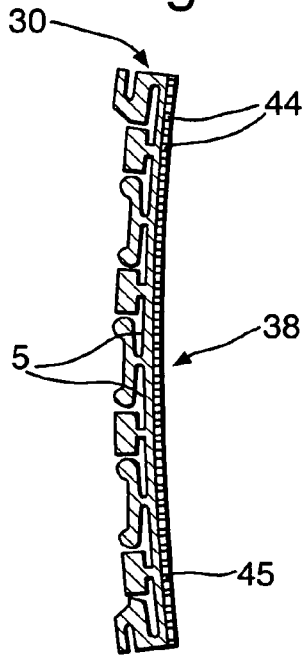
FIG. 4 is a diagrammatic section on the line X—X in FIG. 3.

FIGS. 2 to 4 illustrates a turbine seal segment 30 for the high pressure turbine 22. A plurality of arc shaped sealing elements in the form of a turbine seal segment together form a substantially cylindrical seal segment ring which encases the rotating high pressure turbine blades 32 (see FIG. 2). A small gap 34 is provided between the tips 36 of the turbine blades 32 and a radially inner surface 33 of the seal segment 30. The size of the gap 34 varies with time for various reasons, including variations in the temperatures of the turbine blades 32 and other components.

Referring to the figures, according to an embodiment of the invention, an open cell structure 38 is formed integrally with the turbine seal segment 30 in the region of its radially inner surface 33. The open cell structure 38 includes upstanding walls 40 which project radially inwardly. The walls 40 define therebetween a plurality of open cells 44, the cells 44 having generally circumferential bases 42. The cells 44 are able to receive and support an abradable material 45 such as a metallic powder.

Figure 5:
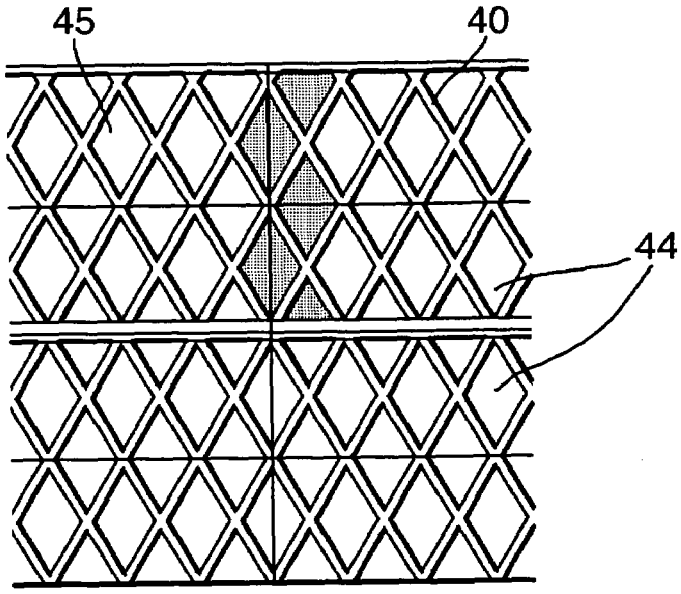
FIG. 5 is a diagrammatic partial detail of a cell structure of a turbine seal segment according to the invention.

In the example illustrated in FIG. 5, the cells 44 are generally diamond shaped when viewed in the radial direction of the turbine and the walls are oriented at about 30° to the axial direction of the turbine, in use. A first set of generally parallel walls crosses over and intersects a second set of generally parallel walls to form the diamond shaped cells 44.

The walls 40 may project up to about 3 mm radially inwardly from the surface 42. The walls 40 have a width of about 0.2 mm to 0.4 mm and the generally parallel walls are positioned about 2 mm to 2.5 mm apart. In the example illustrated, the walls are generally rectangular in section, although one skilled in the art would appreciate that other cross-sectional shapes may achieve the same effect.

Cooling channels 46 are provided within the seal segment 30, radially outwardly of the cell structure 38. Air flowing through the cooling channels helps to cool the cell structure 38 and any abradable material 45 located therein.

The open cell structure 38 may be formed by laser weld deposition. The weld alloy chosen need not be made from the same material as the seal segment 30. In fact there may be advantages in choosing a different material. The use of a highly oxidation resistant material to form the cell structure 38 obviates the needs to form the segment 30 from such a material.

Figure 6:
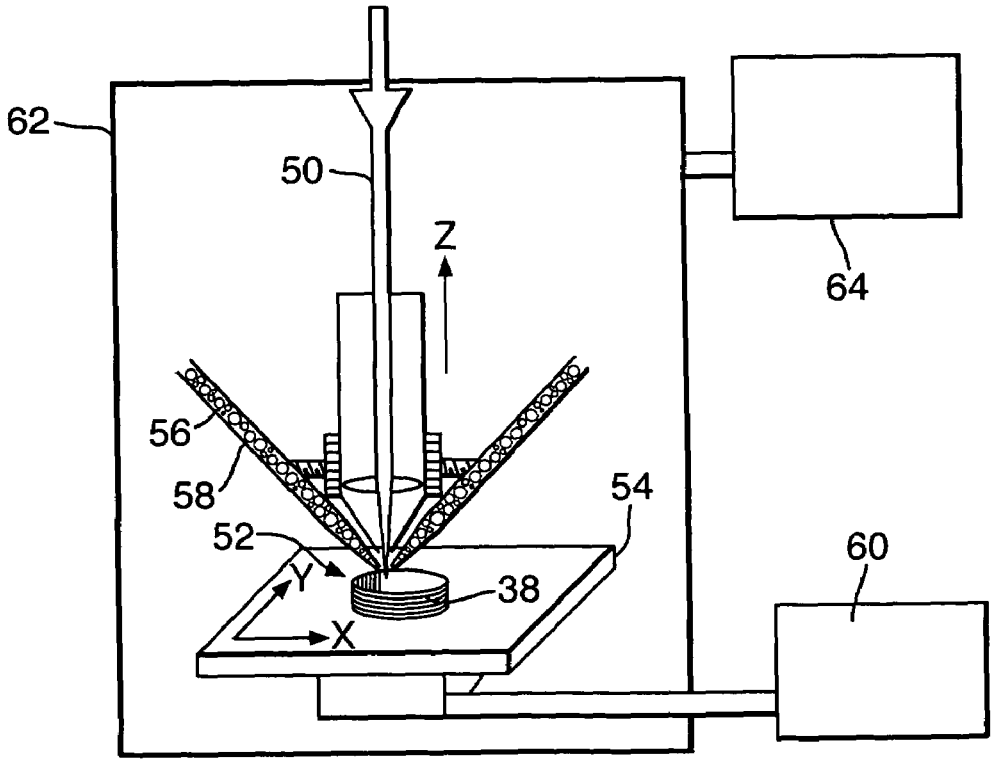
FIG. 6 is a pictorial representation of the laser welding apparatus set up.

Referring now to FIG. 6, a laser 50 is provided and focused down to provide the required energy density at a working region 52 on the substrate 54. Powder 56 is supplied via powder feed tubes 58 to the working region 52. The laser 50 and the powder feed tubes 58 are all held static. The position and movement of the substrate is controlled by a computer control system 60. The focused laser melts the powder 56 and the substrate 54 which mix and solidify when the laser 50 moves to a new position. In order to build up the structure 38 the laser may need to pass over the same region a number of times. Each pass puts down approximately 0.5 mm. The laser welding equipment and working region 52 are enclosed in a sealed compartment 62 or "glove box" in which the oxygen and moisture level is controlled by a gas purifier 64. This provides a controlled atmosphere, thereby preventing contamination of the weld pool.

Figure 7A:
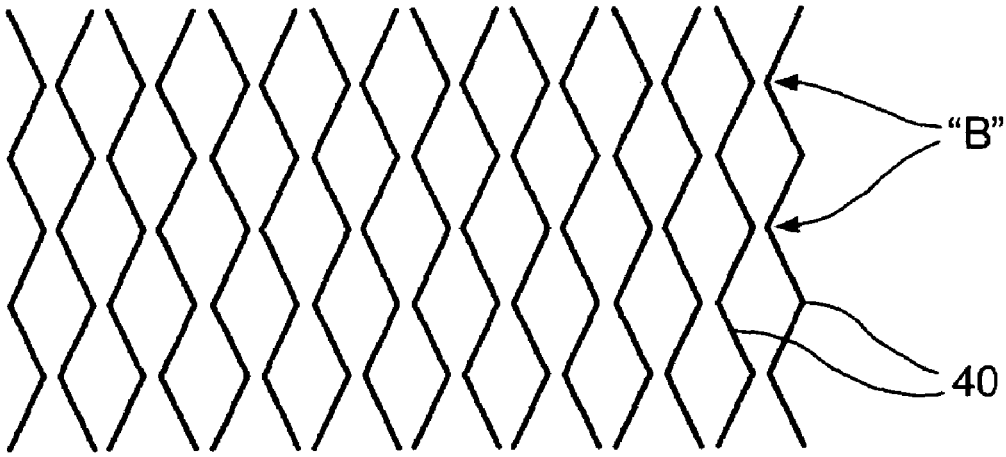
FIG. 7A is a pictorial representation of the structure of one embodiment of the cell structure.

In constructing the walls 40, particular advantage is found in avoiding the crossing over of weld material. By way of non limiting example, in the construction of the diamond shaped pattern, lines of weld are laid down to form adjacent zigzag lines, positioned such that the apex of each zigzag line is in close proximity to the apex of an adjacent zigzag line as shown in FIG. 7A.

Figure 7B:
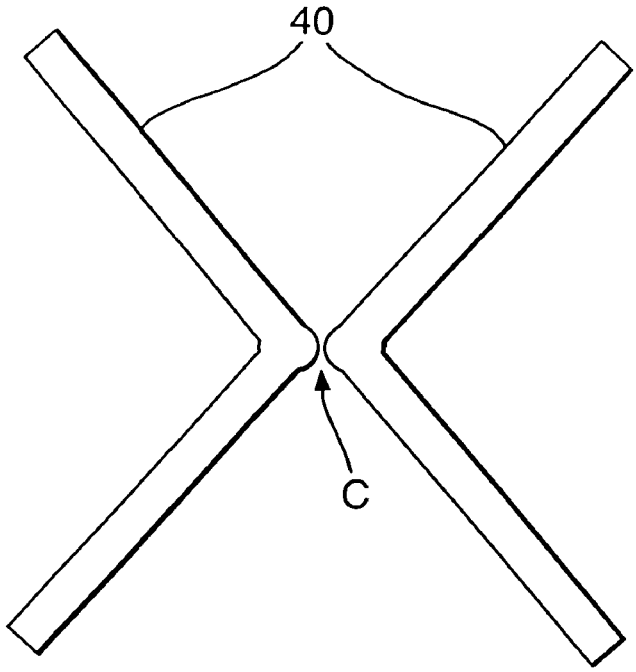
FIG. 7B is a pictorial representation of the structure as shown in FIG. 7A with undersize walls.
Figure 7C:
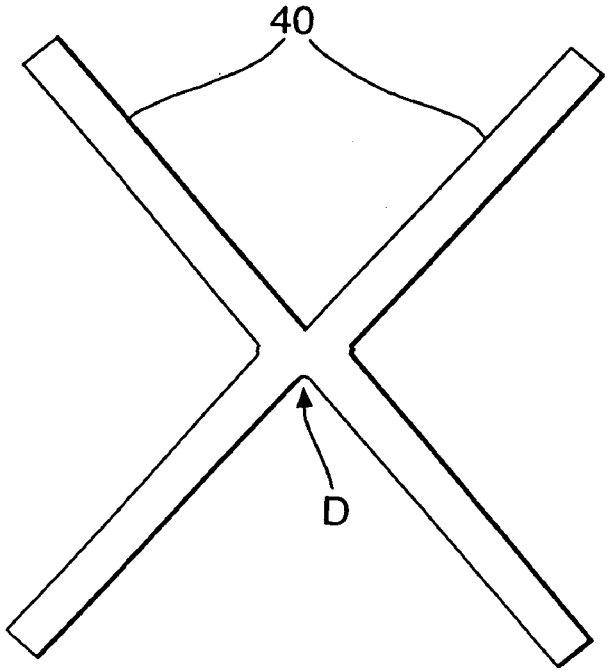
FIG. 7C is a pictorial representation of the structure as shown in FIG. 7A with oversize walls.

Preferably the apex of each zigzag line should touch the apex of an adjacent zigzag weld line as it has been shown that such a configuration will enhance structural integrity of such a structure. It will be appreciated that the thickness of the walls 40 may not be constant. In regions where the wall thickness is undersize there will be a gap between apex's of the zigzag lines as indicated at "C" in FIG. 7B. Conversely in regions where the wall thickness is oversize the apex of the adjacent zigzag lines will overlap as indicated at "D" in FIG. 7C.

Avoiding the crossing over of weld and/or of weld overlap ensures the integrity of the weld is maintained. It has been found that if the weld lines do cross over, the larger amount of material deposited at the node may form a dimple (or "dome") of weld. This introduces residual stress at the node that may result in cracks and voids being formed. The cracks may spread to the rest of the structure.

Hence it will be appreciated that the preferred configuration comprises a wall structure wherein the majority of the zigzag weld line apex's are touching, rather than overlapping or formed with a small gap between the weld line apex's.

Although it will be appreciated that any suitable combination of equipment may be employed, it has been found that $CO_2$ laser of type TR1750/380 (Wegmann-Baasel Laser GmbH) used in conjunction with a Sulzer Metco type 9MPE powder feed unit, a X-Y table and Z-axis motor, and a CNC control unit produce the required results.

The following operational parameters have been found to produce satisfactory results:

laser power: between 144 to 432 W laser scanning speed: between 200 to 400 mm/min powder feed rate: between 8 to 20 g/min powder carrier gas: argon carrier gas flow rate: 12 l/min.

The laser 50 is operated in pulse mode, the pulse frequency being set at 1 kHz. The peak and trough of the pulse is set to 100% and 0% of the setting power respectively. In order to obtain the desired small focal spot of the laser beam, it may be required to position a beam expander (not shown) above the focal lens.

Particular benefit was found in employing four powder feed tubes 58. The four tubes were arranged symmetrically and equi-spaced around the laser beam 50, with the angle between each of the tubes 58 and the laser 50 set to 30°.

It will be appreciated that the above are cited only as examples and that satisfactory results may be achieved with equipment having a different specification and configuration.

Prior to deposition the surface of the substrate 54 is scanned with the laser 50 along the paths where the walls 40 are to be built. This action cleans off any contaminants such as oxide film from the surface of the substrate 54, thereby improving the bond between the substrate 54 and the wall 40.

It was found to be of particular benefit to use a relatively high laser power setting for the cleaning scan and for the first few welding passes than for subsequent welding passes. Doing so heats up the substrate 54, thereby improving the bond between the substrate 54 and the structure 38.

The substrate 54 is selected from at least one of a group of materials comprising nickel based superalloys, CMSX-4, MM002, C1023 and IN713LC. A man skilled in the art would appreciate that this list is not exhaustive.

The powder 56 is selected from at least one of a group of materials comprising CM186, Rene 142, Haynes 214 and Amdry 955. A man skilled in the art would appreciate that this list is not exhaustive. The powder size used was in the range of 50 μm to 100 μm, although it will be appreciated that other powder sizes may prove to have equal utility.

After the cell structure 38 has been formed it may need to be machined to achieve the desired profile. The surfaces of the cells 44 may be nickel plated, and the cells 44 may subsequently be filled with an abradable material 45. Alternatively, the cells may be overfilled, such that the abradable material 45 projects radially inwardly beyond the radially inner edges of the walls 40. In this case, the open cell structure 38 acts as a retention system for the abradable material 45, thus minimising damage to the walls 40.

The abradable material 45 is selected from at least one of a group of materials comprising Porous YSZ, porous Alumina and hollow NiAl powder. A man skilled in the art would appreciate that this list is not exhaustive.

The above described embodiment thus provides a turbine seal segment which overcomes many of the problems associated with the prior art. There is no brazed joint between the open cell structure 38 and the remainder of the seal segment 30 and thus no possibility of the open cell structure 38 becoming detached from the substrate 54. In addition, the depth of the abradable material 45 may be reduced since extra depth to accommodate wicked braze material is not required. Additionally, the described embodiment has the advantage over electro discharge machining in that having worn away the structure formed by electro discharge machining there is no material available to form a new cell structure 38. The described embodiment provides a means for adding material to the seal segment 30.

The walls of the open cell structure 38 have a relatively high oxidation resistance and are easily cooled because they are positioned near to the cooling channels 46.

In use the blade tips of the high pressure turbine blades 32 wear away the abradable material 45 and the walls 40.

Figure 8:
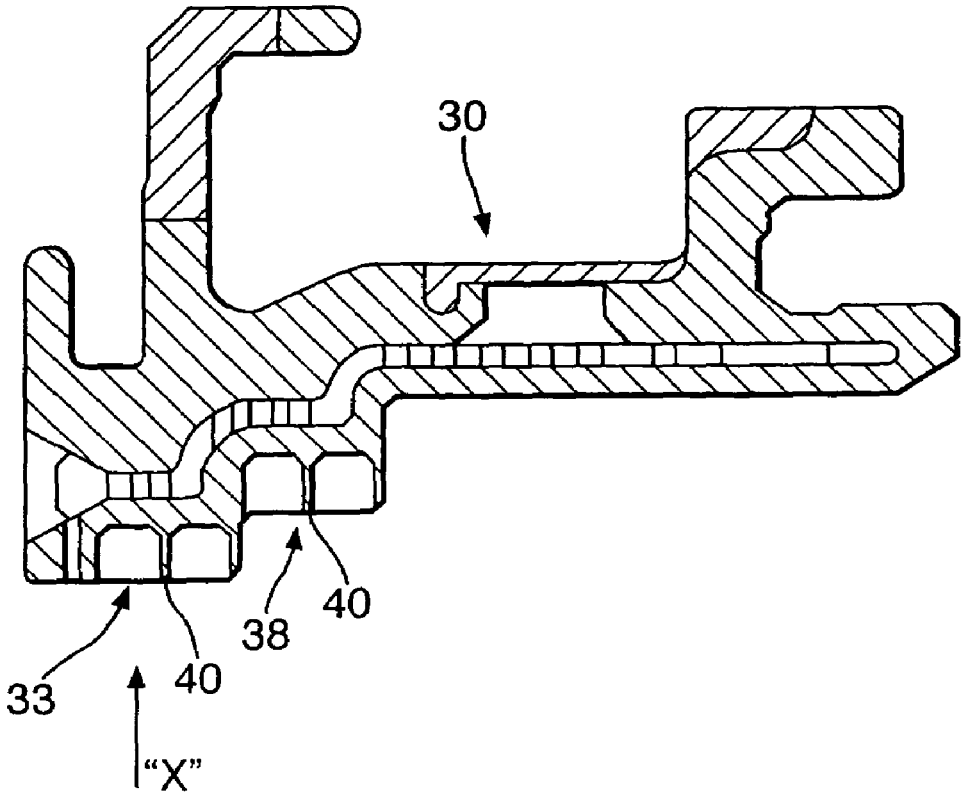
FIG. 8 is a diagrammatic section through an alternative turbine seal segment according to the invention.
Figure 9:
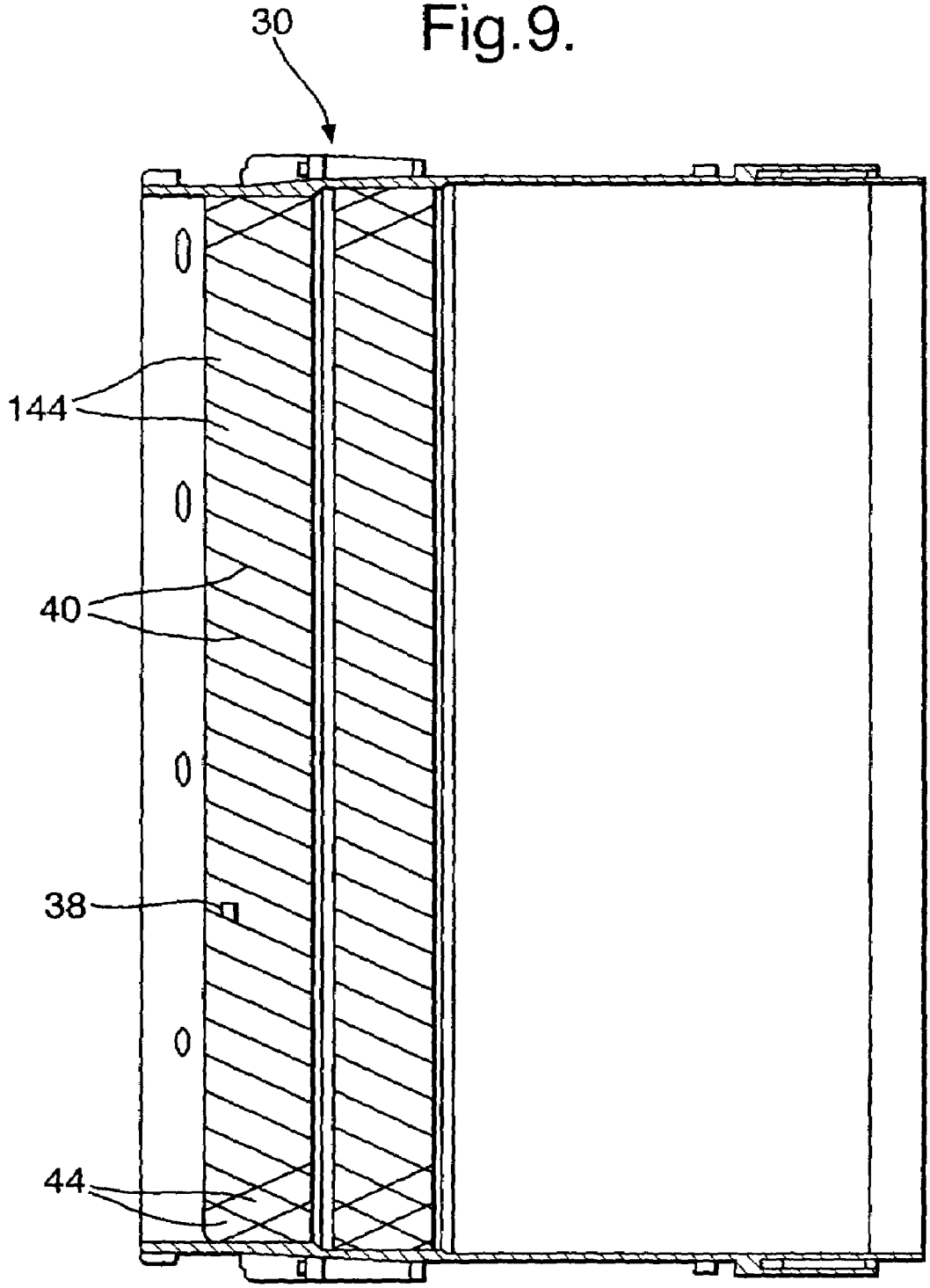
FIG. 9 is a diagrammatic view in the direction of the arrow x in FIG. 8.

FIGS. 8 and 9 illustrate an alternative embodiment of the invention, in which corresponding reference numerals are used for equivalent parts. In this embodiment the open cell structure 38 includes upstanding walls 40 which define therebetween a plurality of cells. In this embodiment a small number of generally diamond shaped cells 44 are located at the outer edges of the seal segment. However the majority of the cells 144 form elongate rhomboid shapes when viewed in the radial direction of the turbine.

Various modifications may be made to the above described embodiment without departing from the scope of the invention. The section of the walls illustrated is generally rectangular. However, an "Eiffel tower" section may be used, to improve cooling. In this embodiment, the width of the walls 40 is increased towards their bases, thus providing improved transfer of heat to the cooling channels 46.

The width of the walls 40 may however be somewhat increased at their radially inner edges, forming a re-entrant shape, thus helping to prevent abradable material 45 from becoming detached from the cell structure.

The open cells 38 need not be diamond or rhomboid shaped, but for example may be rectangular, triangular, etc. The cells 38 may be discrete as illustrated, or may interconnect with one another.

Figure 10:
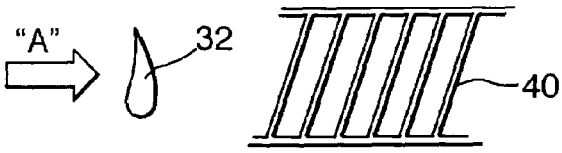
FIG. 10 is a diagrammatic view of an alternative embodiment of the cell structure.
Figure 11:
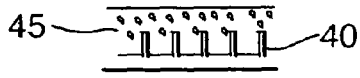
FIG. 11 is a cross sectional view of the cell structure.

A plurality of closely spaced walls or rails, which may be parallel, may form a seal structure. In an alternative embodiment the walls 40, as shown in FIG. 10, are configured at an angle to the longitudinal axis of the engine. A cross section through this structure, as shown in FIG. 11, illustrates overfill of the cell structure 40 with the abradable 45.

Figure 12:
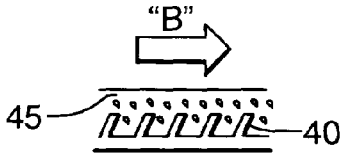
FIG. 12 is a cross sectional view of an alternative embodiment of the cell structure.

FIG. 12 illustrates a cross section of an alternative embodiment wherein the walls 40 are inclined in the direction of travel of the turbine blade 32, as indicated by arrow "B". The walls 40 are inclined up to about 30 degrees from the radial direction.

Figure 13:
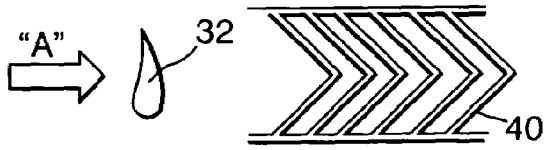
FIG. 13 is a diagrammatic view of an alternative embodiment of the cell structure.
Figure 14:
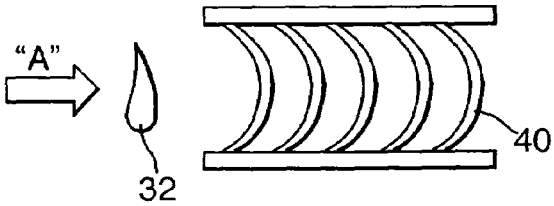
FIG. 14 is a diagrammatic view of an alternative embodiment of the cell structure.
Figure 15:
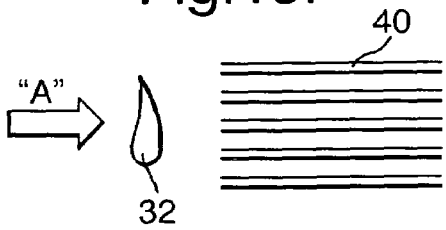
FIG. 15 is a diagrammatic view of an alternative embodiment of the cell structure.

In an alternative embodiment the walls 40 may be formed in a chevron pattern, with the chevrons orientated circumferentially, as shown in FIG. 13. This configuration has been found to not only to resist coating loss through thermal shock but also to reduce loss of coating from the rails during blade incursion. Additionally it has been found that the chevron configuration, arranged so that the wall 40 is angled such that it trails behind both the leading and trailing edges of the blade 32, produces a cleaner cut of the blade 32 than were the wall 40 angled forwards. An arc arrangement as shown in FIG. 14 would produce the same effect. A configuration where the walls 40 are provided substantially circumferentially around the radially inner surface of the sealing element, that is to say normal to the blade direction as in FIG. 15, will also produce a clean cut of the blade 32.

In the embodiments described in FIG. 10 to 15 it can be appreciated that if the direction of travel of the turbine blade 32 across the structure is as shown generally by arrow "A" then the cell structure 40 will act as a retention matrix for abradable material 45.

Alternatively the seal structure 38 may form the seal with no additional sealing material being used. The weld alloy, and consequently the cell walls 40, may be utilised as an abradable.

Subsequent to deposition, electro-chemical machining or etching may be used to reduce the thickness of the walls 40 in the sealing structure 38.

It will be appreciated that the method of producing the projecting walls 40 can also be employed to restore or refurbish thin wall abradable grids that have deteriorated in service.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method of manufacturing a sealing element that can be positioned radially outward from at least some aerofoil blades in a gas turbine engine, the method comprising:

forming a seal structure having a radially inner surface region;

forming a plurality of projecting walls at the radially inner surface region by power-fed laser weld deposition;

wherein:

the projecting walls are configured on the seal structure to form a plurality of open cells; and the projecting walls have a thickness of up to about 0.4 mm.

2. The method of claim 1, wherein forming the seal structure comprises forming a seal structure configured to form at least a part of a generally annular housing for surrounding tips of the aerofoil blades.

3. The method of claim 1, wherein the projecting walls are formed to project substantially radially inward from the radially inner surface region.

4. The method of claim 1, wherein the projecting walls are formed to project inwardly in a direction inclined from a radial direction by about 30 degrees or less.

5. The method of claim 1, wherein radially inner edges of the projecting walls are formed to define a substantially are shaped inner face of the sealing element.

6. The method of claim 1, wherein the seal structure is formed over substantially the whole of a radially inner surface region of the sealing element.

7. The method of claim 1, wherein at least one of the projecting walls is formed to have a thickness that generally decreases toward a radially inner edge of the at least one projecting wall.

8. The method of claim 1, wherein at least one of the projecting walls is formed to have a thickness that generally inner edge of the at least one projecting wall.

9. The method of claim 1, wherein each cell is open only at a radially inner side.

10. The method of claim 1, wherein at least one of the cells is substantially diamond shaped when viewed in the radial direction.

11. The method of claim 1, wherein the projecting walls are formed in a chevron pattern.

12. The method of claim 1, wherein the projecting walls are formed in an arcuate pattern.

13. The method of claim 1, wherein the projecting walls are formed at an angle to a longitudinal axis of the gas turbine engine.

14. The method of claim 1, wherein the inwardly projecting walls are formed substantially circumferentially around the radially inner surface of the sealing element.

15. The method of claim 1, further comprising at least partially filling openings between the projecting walls with an abradable sealing material.

16. The method of claim 15, wherein the abradable sealing material protrudes radially inward beyond radially inner edges of the projecting walls.

17. The method of claim 1, wherein the projecting walls are formed of an abradable material.

18. The method of claim 17, wherein the abradable material comprises at least one member of the group consisting of porous YSZ, porous Alumina and hollow NiAl powder.

19. The method of claim 1, wherein the sealing element is formed of a substrate material comprising at least one member selected from the group consisting of nickel-based superalloys, CMSX-4, MM002, C1023 and IN713LC.

20. The method of claim 1, wherein the projecting walls are formed from a weld powder material comprising at least one member selected from the group consisting of CM186, Rene 142, Haynes 214 and Amdry 955.

21. The method of claim 1, wherein the projecting walls have a height up by about 3 mm.

22. The method of claim 1, wherein the projecting walls are spaced apart by about 2 mm.

23. The method of claim 1, further comprising machining the projecting walls.

24. The method of claim 23, wherein the projecting walls are machined using electro-chemical machining or etching.

25. The method of manufacturing a seal segment ring for a turbine of a gas turbine engine, comprising:

forming a plurality of sealing elements by the method of claim 1; and assembling the plurality of sealing elements to form the seal segment.

26. A method of manufacturing a gas turbine engine, comprising:

forming a seal segment ring by the method of claim 25; and incorporating the seal segment ring into a turbine.

27. The method of claim 26, wherein the turbine is a high pressure turbine of the gas turbine engine.

* * * * *